US005670468A

United States Patent [19]

Moens

[11] Patent Number: 5,670,468

[45] Date of Patent: Sep. 23, 1997

[54] MACHINE DISHWASHING METHOD EMPLOYING A METALLO CATALYST AND ENZYMATIC SOURCE OF HYDROGEN PEROXIDE

[75] Inventor: Marnix Karel Christiane Moens, Wielsbeke, Belgium

[73] Assignee: The Procter & Gamble Company, Cincinnati, Ohio

[21] Appl. No.: 537,652

[22] PCT Filed: Mar. 23, 1994

[86] PCT No.: PCT/US94/03169

§ 371 Date: Oct. 10, 1995

§ 102(e) Date: Oct. 10, 1995

[87] PCT Pub. No.: WO94/23637

PCT Pub. Date: Oct. 27, 1994

[30] Foreign Application Priority Data

Apr. 9, 1993 [EP] European Pat. Off. ..... 93870066

[51] Int. Cl.[6] ..... C11D 7/54

[52] U.S. Cl. ..... 510/226; 510/220; 510/374; 510/375; 510/376; 510/508; 510/514

[58] Field of Search ..... 510/220, 226, 510/228, 301, 299, 305, 311, 374, 375, 376, 508, 514

[56] References Cited

U.S. PATENT DOCUMENTS

| | | | |
|---|---|---|---|
| 3,544,473 | 12/1970 | Kitchen et al. | 252/187.25 |
| 3,640,877 | 2/1972 | Gobert et al. | 510/305 |
| 3,927,967 | 12/1975 | Speakman | 8/103 |
| 4,077,768 | 3/1978 | Johnston et al. | 7/107 |
| 4,240,920 | 12/1980 | deLuque | 8/137 |
| 4,464,281 | 8/1984 | Rapisarda et al. | 510/220 |
| 4,810,410 | 3/1989 | Diakun et al. | 8/111 |
| 4,836,946 | 6/1989 | Dixit | 510/222 |
| 4,986,922 | 1/1991 | Snow et al. | 510/329 |

*Primary Examiner*—Paul Lieberman
*Assistant Examiner*—Caroline L. Dvsheck
*Attorney, Agent, or Firm*—Kim William Zerby; T. David Reed; J. C. Rasser

[57] ABSTRACT

The present invention relates to a dishwashing, especially machine dishwashing, method wherein the articles to be washed are treated with an effective amount of a detergent composition comprising: A. a metallo catalyst selected from a) metallo porphin and water-soluble or water dispersable derivatives thereof; b) metallo porphyring and water-soluble or water-dispersable derivatives thereof; c) metallo phthalocyanine and water-soluble or water-dispersable derivatives thereof; and B. an enzymatic system capable of generating hydrogen peroxide.

18 Claims, No Drawings

MACHINE DISHWASHING METHOD EMPLOYING A METALLO CATALYST AND ENZYMATIC SOURCE OF HYDROGEN PEROXIDE

FIELD OF THE INVENTION

The present invention relates to a dishwashing composition and method for inhibiting the redeposition of coloured food soils from the wash solution onto articles in the wash.

BACKGROUND OF THE INVENTION

A well recognized problem arising during modern fabric laundering operations is the tendency of some coloured fabrics to release dye into the laundering solution. The dye is then transferred onto other fabrics being washed therewith.

In dishwashing methods, especially machine dishwashing methods, there exists a related problem, which is however, not recognized in the art. Coloured food soils, comprising natural dyestuffs, may be removed from the articles being washed and then redeposit from the wash solution onto other articles in the wash or onto the interior of the vessel holding the wash solution such as a dishwashing machine.

The problem is particularly noticeable when the washload includes articles soiled by foods naturally containing significant levels of coloured dyestuff molecules, including for example tomato sauce, fruit juices such as blackcurrant juice, and curry.

The Applicants have found that plastic articles in the wash, and areas of the interior of a dishwashing machine, which are made of plastic, are particularly susceptible to the deposition of coloured food dyes from the wash liquor.

A solution to the problem of dye transfer in laundering operations is to bleach the fugitive dyes washed out of dyed fabrics before they have the opportunity to become attached to other articles in the wash.

Suspended or solubilized dyes can to some degree be oxidized in solution by employing known bleaching agents. GB 2 101 167 describes a stable liquid bleaching composition containing a hydrogen peroxide precursor which is activated to yield hydrogen peroxide on dilution.

U.S. Pat. No. 4,077,768 describes a process for inhibiting dye transfer by the use of an oxidizing bleaching agent together with a catalytic compound such as iron porphins. The effectiveness of this process however tends to be limited, particularly in the way that the oxidsing bleaching agent has to be added dropwise in order to obtain the most effective dye transfer inhibition.

Copending EP Patent Application 91202655.6 filed Oct. 9, 1991, provides an efficient dye transfer inhibiting composition which overcomes this limitation of the process of U.S. Pat. No. 4,077,768 and provides a practical way of controlling a low steady state level of hydrogen peroxide.

The aforementioned copending EP Patent Application relates to dye transfer inhibiting compositions comprising an enzymatic system capable of generating hydrogen peroxide and metallo catalysts, especially for use in laundering operations.

The hydrogen peroxide is enzymatically generated in situ by using a hydrogen peroxide precursor plus an oxidase enzyme eg: glucose or alcohol as hydrogen peroxide precursors and respectively glucose oxidase or alcohol oxidase as the enzyme system.

Two other copending EP Patent Applications, 92870019.4 and 9270017.8 provide improved dye transfer inhibiting compositions which also comprise an enzymatic system capable of generating hydrogen peroxide and metallo catalysts, especially for use in laundering operations.

The Applicants have now recognized that certain of the solutions proposed to mitigate dye transfer in laundering operations may also be applied to solve the problem of coloured food dyestuff deposition in a dishwashing method.

The present invention therefore provides a method for dishwashing operations, especially machine dishwashing operations, which mitigates the problem of coloured food dyestuff deposition.

SUMMARY OF THE INVENTION

The present invention relates to a dishwashing method wherein the articles to be washed are treated with an effective amount of a detergent composition comprising:

A. a metallo catalyst selected from a) metallo porphin and water-soluble or water dispersable derivatives thereof;

b) metallo porphyrin and water-soluble or water-dispersable derivatives thereof c) metallo phthalocyanine and water-soluble or water-dispersable derivatives thereof; and B. an enzymatic system capable of generating hydrogen peroxide In another aspect of the invention said detergent composition further comprises certain specific polymers which when added to the detergent composition enhance the overall performance of the dishwashing method. In particular the addition of said polymers eliminates or reduces the deposition of the catalyst onto the articles in the wash. The polymer is selected from a) alkoxy containing polymers b) hydroxy containing polymers c) thiol containing polymers d) amide containing polymers e) heterocyclic amines containing polymers f) polyamines g) polyurethanes h) polyacrylonitriles In yet another aspect of the present invention the detergent composition further comprises certain amine base catalyst stabilizers which are capable of binding to the 5th ligand of the metallo catalyst, and which enhance the performance of the dishwashing method.

In particular, the addition of said catalyst stabilizers reduces the rate of self-destruction of the catalyst resulting in improved through-the-wash stability of the catalyst. Benefits are also obtained in the presence of catalyst stabilizers, due to a substantial reduction in the amount of catalyst deposited onto the articles in the wash. Furthermore, it has been found that said catalyst stabilizers accelerate the oxidation activity of the catalyst thereby increasing the rate of dye bleaching.

The detergent compositions for use in accord with the method of the invention are largely free of conventional bleaching agents such as inorganic perhydrate salts, bleach activators and preformed peracids. Whilst this means that careful formulation is required to ensure that bleachable stain removal is not impaired in the absence of these conventional bleaching agents, their absence may provide benefits in the form of reduced bleach related silver tarnishing.

DETAILED DESCRIPTION OF THE INVENTION

The present invention relates to a dishwashing method wherein the articles to be washed are treated with an effective amount of a detergent composition comprising:

A. a metallo catalyst selected from a) metallo porphin and water-soluble or water dispersable derivatives thereof;

b) metallo porphyrin and water-soluble water-dispersable derivatives thereof c) metallo phthalocyanine and water-soluble or water-dispersable derivatives thereof; and B. an enzymatic system capable of generating hydrogen peroxide

Dishwashing Method

The compositions may be used in essentially any method for washing dishes, including methods with rinsing steps for which a separate rinse aid composition may be added. The metallo catalyst and enzymatic hydrogen peroxide source may also be added as components of any rinse aid. Preferred machine and manual machine dishwashing methods are hereinafter described.

Machine Dishwashing Method

A preferred machine dishwashing method comprises treating soiled articles selected from crockery, glassware, hollowware and cutlery and mixtures thereof, with an aqueous liquid having dissolved or dispensed therein an effective amount of the detergent compositions as described herein. By an effective amount of the composition it is meant from 8 g to 60 g of product dissolved or dispersed in a wash solution of volume from 3 to 10 liters, as are typical product dosages and wash solution volumes commonly employed in conventional machine dishwashing methods.

Manual Dishwashing Method

According to a manual dishwashing method aspect of this invention, soiled dishes are contacted with an effective amount, typically from about 0.5 g to about 20 g (per 25 dishes being treated), preferably from about 3 g to about 10 g, of the detergent compositions described herein. The actual amount of detergent composition used will be based on the judgement of user, and will depend upon factors such as the particular product formulation of the composition, the concentration of the composition, the number of soiled dishes to be cleaned and the degree of soiling of the dishes.

In one preferred manual dishwashing method aspect of the invention a concentrated solution of the detergent composition is applied to the surface of the dishes to be washed. By concentrated solution of the composition it is meant no less than a 20% by weight, preferably no less than 50% by weight product dilution, and most preferably the composition is applied in undiluted form.

In another preferred manual dishwashing method aspect of the invention large volume of a dilute solution of the detergent composition is employed. The dishes are preferably allowed to soak for a period of time, typically from 5 seconds to 30 minutes in the dilute solution.

Metallo Catalyst

The preferred usage range of the catalyst in the wash is $10^{-8}$ molar to $10^{-3}$ molar, more preferred $10^{-6}$–$10^{-4}$ molar.

The essential metallo porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred metallo porphin structures are those substituted at one or more of the 5, 10, 15 and 20 carbon positions of Formula I (Meso positions), with a phenyl or pyridyl substituent selected from the group consisting of

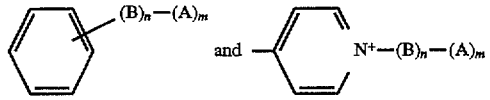

wherein n and m may be 0 or 1; A may be sulfate, sulfonate, phosphate or carboxylate groups; and B is $C_1$–$C_{10}$ alkyl, polyethoxy alkyl or hydroxy alkyl.

Preferred molecules are those in which the substituents on the phenyl or pyridyl groups are selected from the group consisting of $—CH_3$, $—C_2H_5$, $—CH_2CH_2CH_2SO_3—$, $—CH_2—$, and $—CH_2CH(OH)CH_2SO_3—$, $—SO_3$ A particularly preferred metallo phorphin is one in which the molecule is substituted at the 5, 10, 15, and 20 carbon positions with the substituent

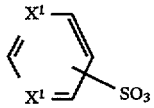

This preferred compound is known as metallo tetrasulfonated tetraphenylporphin. The symbol $X^1$ is (=CY—) wherein each Y, independently, is hydrogen, chlorine, bromine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

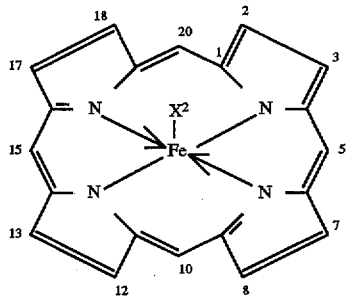

Porphin derivatives also include chlorophyls, chlorines, i.e. isobacterio chlorines and bacteriochlorines.

Metallo porphyrin and water-soluble or water-dispersable derivatives thereof have a structure given in formula II.

(II)

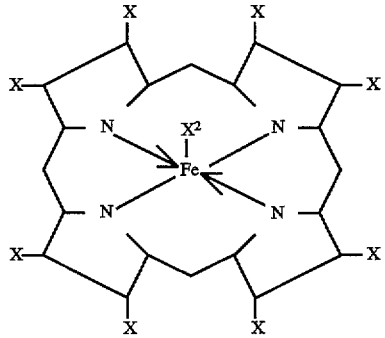

where X can be alkyl, alkyl carboxy, alkyl hydroxyl, vinyl, alkenyl, alkyl sulfate, alkylsulfonate, sulfate, sulfonate.

The symbol $X^2$ of Formula II represents an anion, preferably $OH^-$ or $CL^-$.

The symbol $X_i$ can be alkyl, alkylcarboxy, alkylhydroxyl, vinyl, alkenyl, alkylsulfate, alkylsulfonate, sulfate, sulfonate, aryl.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

(III)

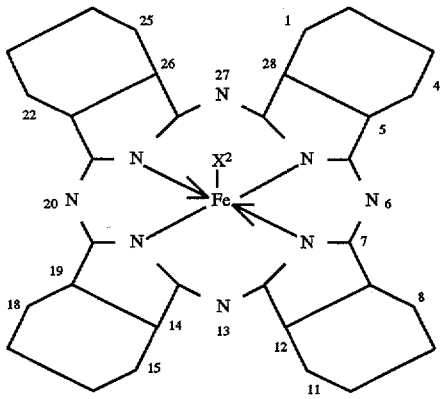

Another form of substitution possible for the present invention is substitution of the central metal by Fe, Mn, Co, Rh, Cr, Ru, Mo or other transition metals.

Still a number of considerations are significant in selecting variants of or substituents in the basic porphin or azaporphin structure. In the first place, one would choose compounds which are available or can be readily synthesized.

Beyond this, the choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas the cationic or zwitterionic compounds may be attracted to, or at least not repelled by such stained surfaces.

The Hydrogen Peroxide Precursor

The oxidizing agent, hydrogen peroxide is generated in situ by using an enzymatic hydrogen peroxide generation system.

The use of an enzymatic hydrogen peroxide generating system allows the continuous generation of low levels of hydrogen peroxide and provides a practical way of controlling a low steady-state level of hydrogen peroxide. Maximum effectiveness occurs when the component levels are such that the hydrogen peroxide is replenished at a rate similar to its removal due to the oxidation of dyes in the wash water.

The enzyme used in the present invention is an oxidase. The oxidase is present by 0.1–20000 units, preferably 0.5 to 5000 units per gram of the composition. One unit is the amount of enzyme needed to convert 1 mole of glucose substrate per minute.

Suitable oxidases are urate oxidase, galactose oxidase, alcohol oxidases, amine oxidases, amino acid oxidases, cholesterol oxidase and glucose oxidase, malate oxidase, glycollate oxidase, hexose oxidase, aryl alcohol oxidase, L-gulonolactose oxidase, pyranose oxidase, L-sorbose oxidase, pyridoxine 4-oxidase, 2-2-hydroxyacid oxidase, choline oxidase, ecdysone oxidase.

The preferred enzymatic systems are alcohol and aldehyde oxidases, glucose oxidase.

The more preferred systems for granular detergent application would have solid alcohols, e.g. glucose whose oxidation is catalysed by glucose oxidase to glucoronic acid with the formation of hydrogen peroxide.

The more preferred systems for liquid detergent application would involve liquid alcohols which could for example, also act as solvents. An example is ethanol/ethanol oxidase.

The quantity of oxidase to be employed in compositions according to the invention should be at least sufficient to provide in the wash a constant generation of 0.005 to 10 ppm AvO per minute in the wash process. For example, with the glucose oxidase , this can be achieved at room temperature and at pH 6 to 11, preferentially 7.5 to 10.5 with 1–20000 U/l glucose oxidase, 0.005 to 2% glucose under constant aeration in the washing process.

Polymeric Agents

In a further aspect of the present invention the dye transfer inhibiting benefits can be optimized by adding small amounts of polymers to the detergent composition.

These polymers of the present invention reduce the deposition of the porphin catalyst onto the articles in the wash.

The compounds suitable for the present invention having reduced deposition effect of the porphin catalyst are polymers having alkoxy moieties. These polymers include copolymeric blocks of ethylene terephthalate and polyethylene oxide or polypropylene oxide terephthalate and the like. These polymers are often used as soil release agents.

More preferred alkoxy containing polymers include polyethylene glycol or polypropylene glycol and derivatives thereof. Particularly preferred are the copolymers of said polymers e.g Pluriol(R).

Another preferred soil release agent is a copolymer having random blocks of ethylene terephthalate and polyethylene oxide (PEO) terephtalate. More specifically, these polymers are comprised of repeating units of ethylene terephthalate and PEO terephthalate in a mole ratio of ethylene terephtalate units to PEO terephthalate units of from 25:75 to 35:65, said PEO terephthalate units containing polyethylene oxide having molecular weights of from 300 to 2000. The molecular weight of this polymer is in the range of from 3,000 to 55,000.

Another preferred polymeric soil release agent is a polyester with repeating units of ethylene terephthalate containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the polymeric compound is between 2:1 and 6:1.

Highly preferred polymers are compounds of formula:

$$X-(OCH_2CH_2)_m[(OC-R^1-CO-R^2)_u(-C(=O)-R^3-CO-R^2)_v]$$

$$OC-R^4-CO-(CH_2CH_2O)_n-X$$

wherein the $R^1$ moieties are all 1,4-phenylene moieties; the $R^2$ moieties are essentially ethylene moieties, 1,2-propylene moieties or mixtures thereof; the R3 moieties are substituted 1,3-phenylene moieties having the substituent $$-CO[(R^2-OC-R^4-CO]_w(CH_2CH_2O)_n-X$$

at the 5 position; the $R^4$ moieties are $R^1$ or $R^3$ moieties, or mixtures thereof; each X is ethyl or preferably methyl; each n is from 12 to 43; when w is 0, u+v is from 3 to 10; when w is at least 1, u+v+w is from 3 to 10. Particularly preferred block polyesters are those where v is 0, i.e. the linear block polyesters. For these most preferred linear block polyesters, u typically ranges from 3 to 8, especially for those made from dimethyl terephthalate, ethylene glycol (or 1,2-propylene glycol) and methyl capped polyethylene glycol. The most water soluble of these linear block polyesters are those where u is from 3 to 5.

Other polymers suitable for inclusion in the detergent compositions for use in the present invention which have polyalkoxymoiety are alkoxylated polyamines. Such materials can conveniently be represented as molecules of the empirical structures with repeating units:

$$-[N(-(alkoxy)_y)-R]-_n \quad \text{Amine form}$$

and $$-[N^+(R^1)(-(alkoxy)_y)-R]-_n\, nX^- \quad \text{Quaternized form}$$

Wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene imines, i.e., the polymerized reaction product of ethylene oxide with ethyleneimine, having the general formula:

$$(EtO)-[N(-(EtO)_y)-CH_2-CH_2]_n-N(-(EtO)_y)$$

$$y = 2\text{–}30$$

Other polymers suitable for use in the present invention are alkoxylated nonionic surfactants.

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Preferred nonionic surfactants for use in the present invention are nonionic surfactants having at least 3, preferably at least 5 ethoxy groups and a $C_{10}$–$C_{20}$ alkyl chain. Suitable nonionic surfactants include polyethyleneoxide condensates of alkyl phenols, condensation products of ethylene oxide with a hydrophobic base formed by the condensation of propylene oxide with propylene glycol or ethylenediamine.

Semi-polar nonionic detergent surfactants which include water-soluble amine oxides, water-soluble phosphine oxides and water-soluble sulfoxides are suitable.

Hydroxy containing polymers, e.g. polyvinyl alcohol and polyaminoacids containing hydroxyl groups such as polyserine, polythreonine and polytyrosine as well as thiol containing polymers such as polycysteine are suitable.

Amide containing polymers are also suitable. These include compounds of formula:

$$H-(NH-R-(CO))_n-OH-(NH-R_1-NH-CO-R_2-CO)_n-OH$$

wherein $R_1$ is amino acid side chain, or alkyl ($C_1$–$C_{12}$) or aryl groups Most preferred amide containing polymer is polyvinyl pyrolidone or alkoxylated derivatives thereof.

Other polymers suitable for the present invention are polyurethanes, polyacrylonitrile and polyamines including polyaminoacids containing basic amino acids such as diamino monocarboxylic aminoacids e.g. lysine, arginine, histidine . . . ), polyethylenimine and ethoxylated amine containing polymers (e.g. tetraethylene pentamine etc.).

Polymers containing heterocyclic amines such as polyvinyl pyridine and derivatives thereof are suitable. Particularly preferred heterocyclic amine is polyvinylimidazoline.

The polymers suitable for the present invention have an average molecular weight within the range of about 1000 to 50,000, preferably from 2000 to 25,000 and most preferred from 2000 to 15,000.

The level of polymer in the detergent composition is from 0.01. to 5% by weight, preferably from 0.1 to 2% and most preferred from 0.2 to 1%.

Amine Base Catalyst Stabilizer

The dye transfer inhibiting benefits can be optimized by adding small amounts of catalyst stabilizers. It is well known in art that catalyst e.g. metallo porphins are susceptible to self-destruction. As a result of said selfdestruction, the level of catalyst should be such that sufficient active catalyst is present to bleach the dyes throughout the total wash cycle. It has now been found that the stability of metallo catalyst used in the present invention is improved by adding amine base catalyst stabilizers capable of binding the 5th ligand of the central atom in the metallo porphin structure. Preferred heterocyclic compounds suitable for the present invention are imidazole compounds of the formula:

$$R_iC(-N)=CH(-N-Y)-X-R_2$$

$$C(-R_1)$$

wherein Y is hydrogen or oxygen or a $C_1$–$C_{12}$ alkyl, $R_i$, $R_1$ and $R_2$ are selected independently hydrogen or $C_1$–$C_{30}$ alkyl or alkenyl groups, and X is selected from the group of:

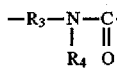

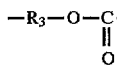

$-R_3-$ $-R_3-O-$ wherein $R_3$ is a $C_1$–$C_5$ alkanediyl group, or is

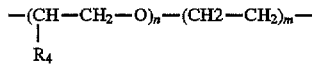

with n being an integer from 0 to 10, and m is an integer from 0 to 2, n+m>1, and $R_4$ being a $C_{1-4}$ alkyl group or hydrogen. Most preferred are imidazole derivatives including histidine, purines, hipoxanthine, imidazolidicarboxylic acid, histamine, polyhistidine, alkylated imidazole.

Other heterocyclic compounds suitable for the present invention are pyridine and alkylated pyridines and derivatives thereof, pyrole and derivatives thereof.

Non heterocyclic compounds capable of binding the 5th ligand of the central atom in the porphin structure are suitable.

These non heterocyclic compounds include non heterocyclic amines, having the formula $(C_2H_5)_3N$, $C_3H_7NH_2$, $(C_6H_{11})_2NH$, 1,5-diazabicyclo[4.3.0]non-5-ene.

Second, the catalyst stabilizers of the present invention reduce the deposition of the porphin catalyst onto the articles in the wash.

Also, it has been found that the addition of the catalyst stabilizers mentioned hereinabove not only results in less self-destruction of the structure but also results in less deposition of oxidized or non oxidized porphin.

Furthermore, it has been found that the rate of dye oxidation by the porphin catalyst is greatly enhanced by the presence of the said catalyst stabilizers. This results in an increased dye bleaching. The amine base catalyst stabilizer is present in a molar ratio of iron porphin to amine base catalyst from 1:1 to 1:5000, preferably from 1:1 to 1:2500.

ADDITIONAL DETERGENT INGREDIENTS

In addition to the ingredients described hereinabove, the detergent compositions for use in accord with the dishwashing method of the invention may comprise additional ingredients, which are often quite desirable ones.

A highly preferred component of a machine dishwashing detergent composition for use in a machine dishwashing method in accord with the present invention is detergent builder compound present at a level of from 1% to 80% by weight, preferably from 10% to 70% by weight, most preferably from 20% to 60% weight of the composition.

Suitable water-soluble detergent builder compounds include, but are not restricted to monomeric polycarboxylates, of their acid forms homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium

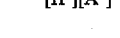

$$H^+ + A^- \rightleftarrows HA$$

where A is the fully ionized carboxylate anion of the builder salt. The equilibrium constant for dilute solutions is therefore given by the expression $$K_1 = \frac{[HA]}{[H^+][A^-]}$$

and $pK_1 = \log_{10} K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae

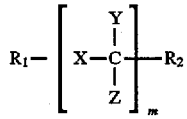

(a)

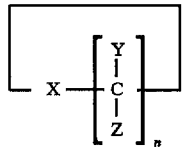

(b)

or

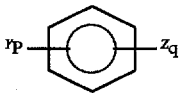

(c)

wherein $R_1$ represents H, $C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H, $C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy; hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

Water-soluble detergent builders include, but are not limited to, the alkali metal, ammonium and alkanolammonium salts of polyphosphates (exemplified by the tripolyphosphates, pyrophosphates, and glassy polymeric meta-phosphates), phytic acid, silicates, carbonates (including bicarbonates and sesquicarbonates), and sulfates. Borate builders, as well as builders containing borate-forming materials that can produce borate under detergent storage or wash conditions can also be used but are not preferred at wash conditions less that about 50° C., especially less than about 40° C.

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$:$Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Silicates are preferably present in machine dishwashing detergent compositions at a level of from 5% to 50% by weight of the composition, more preferably from 10% to 40% by weight.

Whilst water-soluble detergent builders are preferred components of the detergent compositions the compositions may also include less water soluble builders although preferably their levels of incorporation are minimized. Examples of such less water soluble builders include the crystalline layered silicates and the largely water insoluble sodium aluminosilicates. Crystalline layered sodium silicates have the general formula $$NaMSi_xO_{x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and-is preferably 2. More preferably M is sodium and y is 0 and preferred examples of this formula comprise the α—, β—, γ— and δ— forms of $Na_2Si_2O_5$. These materials are available from Hoechst AG FRG as respectively NaSKS-5, NaSKS-7, NaSKS-11 and NaSKS-6. The most preferred material is δ-$Na_2Si_2O_5$, NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof. The primary requirement is that the material should contain at least on functional acidic group of which the pKa should be less than 9, providing a capability for at least partial neutralisation of the hydroxyl ions released by the crystalline layered silicate.

The incorporation in the particulate of other ingredients additional to the crystalline layered silicate and ionisable water soluble compound can be advantageous particularly in the processing of the particulate and also in enhancing the stability of detergent compositions in which the particulates are included. In particular, certain types of agglomerates may require the addition of one or more binder agents in order to assist in binding the silicate and ionisable water soluble material so as to produce particulates with acceptable physical characteristics.

The crystalline layered sodium silicate containing particulates can take a variety of physical forms such as extrudates, marumes, agglomerates, flakes or compacted granules. A preferred process for preparing compacted granules comprising crystalline layered silicate and a solid, water-soluble ionisable material has been disclosed in the commonly assigned British Application No. 9108639.7 filed on Apr. 23, 1991.

Suitable aluminosilicate zeolites have the unit cell formula $Na_z[(AlO_2)_z(SiO_2)y].XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [4 grains/gallon/minute/(gram/gallon)], based on calcium ion hardness.

Optimum aluminosilicates for builder purpose exhibit a calcium ion exchange rate of at least 260 mg equivalent of $CaCO_3$/liter/minute/(gram/liter) [4 grains/gallon/minute/(gram/gallon)].

The aluminosilicate ion exchange materials can be naturally occurring materials, but are preferably synthetically derived. A method for producing aluminosilicate ion exchange materials is discussed in U.S. Pat. No. 3,985,669. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[ALO_2)_{12}(SIO_2)_{12}].xH_2O$$

wherein x is from 20 to 30, especially 27. Zeolite X has the formula $Na_{86}$ $[(AlO_2)_{86}(SiO_2)_{106}]$. 276 $H_2O$ has the formula $Na_6$ $[(AlO_2)_6(SiO_2)_6]$ 7.5 $H_2O$).

A highly preferred component of the compositions for use in accord with the invention is a surfactant system comprising surfactant selected from anionic, cationic, nonionic ampholytic and zwitterionic surfactants and mixtures thereof. The surfactant system is present at a level of from 0.5% to 50% by weight, more preferably 1% to 40% by weight, most preferably from 2% to 30% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given in EP-A-0414 549.

Sulphonate and sulphate surfactants are useful herein. Sulphonates include alkyl benzene sulphonates having from 5 to 15 carbon atoms in the alkyl radical, and alpha-sulphonated methyl fatty acid testers in which the fatty acid is derived from a $C_6$–$C_{18}$ fatty source. Preferred sulphate surfactants are alkyl sulphates having from 6 to 16, preferably 6 to 10 carbon atoms in the alkyl radical.

Useful surfactant system comprises a mixture of two alkyl sulphate materials whose respective mean chain lengths differ from each other. The cation in each instance is again an alkali metal, preferably sodium. The alkyl sulfate salts may be derived from natural or synthetic hydrocarbon sources.

The $C_6$–$C_{16}$ alkyl ethoxysulfate salt comprises a primary alkyl ethoxysulfate which is derived from the condensation product of a $C_6$–$C_{16}$ alcohol condensed with an average of from one to seven ethylene oxide groups, per mole. Preferred are the $C_6$–$C_{10}$ alkyl ethoxysulfate salts with an average of from one to five ethoxy groups per mole.

Other anionic surfactants suitable for the purposes of the invention are the alkali metal sarcosinates of formula $$R—CON(R^1)CH_2COOM$$

wherein R is a $C_5$–$C_{17}$ linear or branched alkyl or alkenyl group, $R^1$ is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

Another class of anionic surfactants useful herein are the alkyl ester sulfonate surfactants which include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactants have the structural formula:

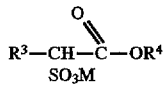

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

One class of nonionic surfactants useful in the present invention comprises the water soluble ethoxylated $C_6$–$C_{16}$ fatty alcohols and $C_6$–$C_{16}$ mixed ethoxylated/propoxylated fatty alcohols and mixtures thereof. Preferably the ethoxylated fatty alcohols are the $C_{10}$–$C_{16}$ ethoxylated fatty alcohols with a degree of ethoxylation of from 3 to 50, most preferably these are the $C_{12}$–$C_{16}$ ethoxylated fatty alcohols with a degree of ethoxylation from 3 to 40. Preferably the mixed ethoxylated/propoxylated fatty alcohols have an alkyl chain length of from 10 to 16 carbon atoms, a degree of ethoxylation of from 3 to 30 and a degree of propoxylation of from 1 to 10.

Thus C6–C16 alcohol itself can be obtained from natural or synthetic sources. Thus, C6–C16 alcohols, derived from natural fats, or Ziegler olefin build-up, or OXO synthesis can form suitable sources for the alkyl group. Examples of synthetically derived materials include Dobanol 25 (RTM)

sold by Shell Chemicals (UK) Ltd which is a blend of $C_{12}$–$C_{15}$ alcohols, Ethyl 24 sold by the Ethyl Corporation, a blend of $C_{12}$–$C_{15}$ alcohols, Ethyl 24 sold by the Ethyl Corporation, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd., and Lial 125 sold by Liquichimica Italiana. Examples of naturally occuring materials from which the alcohols can be derived are coconut oil and palm kernel oil and the corresponding fatty acids.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 6 to 16 carbon atoms preferably from 6 to 14 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Another preferred nonionic surfactant is a polyhydroxy fatty acid amide surfactant compound having the structural formula:

$$R^2-\overset{\overset{\displaystyle O}{\|}}{C}-\overset{\overset{\displaystyle R^1}{|}}{N}-Z$$

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (ie., methyl); and $R^2$ is a $C_5$–$C_{15}$ hydrocarbyl, preferably straight chain $C_5$–$C_{13}$ alkyl or alkenyl, more preferably straight chain $C_5$–$C_{11}$ alkyl or alkenyl, most preferably straight chain $C_5$–$C_9$ alkyl or alkenyl, or mixture thereof: and Z is a polyhydroxyhydrocarbyl having linear hydrocarbyl chain with at least 3 hydroxyls directly connected to the chain, or an alkoxlylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, or tallowamide.

Z can be 1-deoxyglucityl, 2-deoxyfrucittyl, 1-deoxymaltityl, 1-deoxylactityl, 1-deoxygalactityl or 1-deoxymannityl, or 1-deoxymalto-triotityl. Preferred compounds are N-methyl N-1deoxyglucityl $C_{14}$–$C_{18}$ fatty acid amides.

A further class of surfactants are the semi-polar surfactants such as amine oxides. Suitable amine oxides are selected from mono $C_6$–$C_{20}$, preferably $C_6$–$C_{10}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Another optional ingredient useful in detergent compositions is one or more enzymes.

Preferred enzymatic materials include amylases, neutral and alkaline proteases, lipases, and esterases conventionally incorporated into detergent compositions. Suitable enzymes are discussed in U.S. Pat. Nos. 3,519,570 and 3,533,139.

Preferred commercially available protease enzymes include those sold under the tradenames Alcalase and Savinase by Novo Industries A/S (Denmark) and Maxatase by International Bio-Synthetics, Inc. (The Netherlands). Protease enzyme may be incorporated at a level of from 0.005% to 2% active enzyme by weight of the composition.

Preferred amylases include, for example, α-amylases obtained from a special strain of B licheniforms, described in more detail in GB 1,269,839 (Novo). Preferred commercially available amylases include for example, Rapidase, sold by International Bio-Synthetics Inc, and Termamyl, sold by Novo Industries A/S. Amylase enzymes may be incorporated at a level of from 0.001% to 2% active enzyme by weight of the composition.

A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene is *Aspergillus oryza*, as host, as described in European Patent Application, EP-A-0258068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

The detergent compositions may contain from 0.05% to 2.5%, preferably from 0.1% to 0.6% by weight of the total composition of a paraffin oil typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Another optional ingredient is a lime soap dispersant compound, present at a level of from 0.05% to 40% by weight, more preferably 0.1% to 20% by weight, most preferably from 0.25% to 10% by weight of the compositions.

A lime soap dispersant is a material that prevents the precipitation of alkali metal, ammonium or amine salts of fatty acids by calcium or magnesium ions. Preferred lime soap dispersants include C13–15 ethoxylated alcohol sulphates with an average degree of ethoxylation of 3.

The compositions may fully contain from 0.05% to 2% by weight of the composition, preferably from 0.05% to 1% by weight, most preferably from 0.1% to 0.5% by weight of a chelant (heavy metal sequestrant).

A suitable chelant for inclusion in the detergent compositions in accordance with the invention is ethylenediamine- N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2EDDS$ and $Na_4EDDS$. Examples of such preferred magnesium salts of EDDS include MgEDDS and $Mg_2EDDS$. The magnesium salts are the most preferred for inclusion in compositions in accordance with the invention.

Other chelants include the organic phosphonates, including amino alkylene poly (alkylene phosphonate), alkali metal ethane 1-hydroxy diphosphonates, nitrilo trimethylene phosphonates, ethylene diamine tetra methylene phosphonates and diethylene triamine penta methylene phosphonates. The phosphonate compounds may be present either in their acid form or as a complex of either an alkali or alkaline metal ion, the molar ratio of said metal ion to said phosphonate compound being at least 1:1. Such complexes are described in U.S. Pat. No. 4,259,200. Preferably, the organic phosphonate compounds where present are in the form of their magnesium salt. The level of phosphorus containing chelants in the compositions of the invention is preferably minimised, with their complete exclusion from the compositions being most preferred.

Another optional component of the compositions of the invention is a silicone suds controlling agent present at levels of from 0.01% to 5% by weight, more preferably from 0.05% to 3% by weight, most preferably from 0.05% to 1% by weight of the composition.

By silicone suds controlling agent it is meant any suds controlling agent which comprises a silicone antifoam compound. Thus silicone suds controlling agents include agents containing silicone-silica mixtures and particulates in which the silicone, or silicone-silica mixture, is incorporated in a water-soluble or water-dispersible carrier material. Alternatively, the silicone suds controlling agents may comprise silicone, or silicone-silica mixutes dissolved or dispersed in a liquid carrier and applied by spraying on to one or more of the other components of the detergent composition. In industrial practice the term "silicone" has become a generic term which encompasses a variety of relatively high molecular weight polymers containing siloxane units and hydrocarbyl group of various types.

Generally, the silicone antifoam compounds can be described as siloxanes having the general structure:

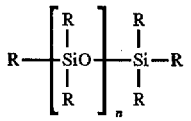

where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from $5\times10^{-5}$ $m^2/s$ to 0.1 $m^2/s$ i.e. a value of n in the range 40 to 1500. These are preferred because of their ready availability and their relatively low cost.

A preferred type of silicone suds controlling agent useful in the compositions herein comprises a mixture of an alkylated siloxane of the type hereinabove disclosed and solid silica.

The solid silica can be a fumed silica, a precipitated silica or a silica made by the gelformation technique. The silica particles suitable have an average particle size of from 0.1 to 50 micrometers, preferably from 1 to 20 micrometers and a surface area of at least 50 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. The suds controlling agents for inclusion in the detergent compositions in accordance with the invention suitably contain an amount of silica such that the weight ratio of silica to silicone lies in the range from 1:100 to 3:10, preferably from 1:50 to 1:7.

A preferred silicone suds controlling agent is represented by a hydrophobic silanated (most preferably trimethylsilanated)silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

Another preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

A highly preferred silicone suds controlling agent is a particulate of the type disclosed in EP-A-0210731 comprising a silicone antifoam and an organic material having a melting point in the range 50° to 85° C., wherein the organic material comprises a monoester of glycerol and a fatty acid having a carbon chain containing from 12 to 20 carbon atoms. EP-A-0210721 discloses similar particulate suds controlling agents wherein the organic material however, is a fatty acid or alcohol having a carbon chain containing from 12 to 20 carbon atoms, or a mixture thereof, with a melting point of from 45° C. to 80° C.

Other highly preferred silicone suds controlling agents are described in copending European Application 91870007.1 in the name of the Procter and Gamble Company which discloses granular suds controlling agents comprising a silicone antifoam compound, a carrier material an organic coating material and glycerol at a weight ratio of glycerol: silicone antifoam compound of 1:2 to 3:1. Copending European Application 91201342.0 also discloses highly preferred granular suds controlling agents comprising a silicone antifoam compound, a carrier material, an organic coating material and crystalline or amorphous aluminosilicate at a weight ratio of aluminosilicate: silicone antifoam compound of 1:3 to 3:1. Ther preferred carrier material in both of the above described highly preferred granular suds controlling agents is starch.

The preferred methods of incorporation of the silicone suds controlling agents comprise either application of the silicone suds controlling agent in liquid form by spray-on to one or more of the major components of the composition or alternatively the formation of the silicone suds controlling agents into separate particulates that can then be mixed with the other solid components of the composition. The incorporation of the suds controlling agents as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds controlling particulates are disclosed in the previously mentioned Bartolotta et al U.S. Pat. No. 3,933,672.

Other optional ingredients suitable for inclusion in the compositions include antiredeposition, and soil-suspension agents, corrosion inhibition, perfumes, colours and filler salts, with sodium sulfate being a preferred filler salt.

Form of the Compositions

The compositions can be formulated in any desirable form such as powders, granulates, pastes, liquids, gels and tablets.

The bulk density of granular compositions is typically of at least 650 g/liter, more usually at least 700 g/liter and more preferably from 800 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrial cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge., The filled cup is then weighed and the value obtained for the weight of powder doubled to provide the bulk density in g/liter. Replicate measurements are made as required.

The particle size of the components of granular compositions should preferably be such that no more that 5% of particles are greater than 1.4 mm in diameter and not more than 5% of particles are less than 0.15 mm in diameter.

Generally, if the compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise. In many cases it is desirable to include a viscosity control agent or a thixotropic agent to provide a suitable liquid product form. Suitable thixotropic or viscosity control agents include methyl cellulose, carboxymethylcellulose, starch, polyvinyl, pyrrolidone, gelatin, colloidal silica, and natural or synthetic clay minerals.

Pasty compositions in accordance with the invention generally have viscosities of about 5,000 centipoise and up to several hundred million centipoise. In order to provide satisfaction pasty compositions a small amount of a solvent or solubilizing agent or of a gel-forming agent can be included. Most commonly, water is used in this context and forms the continuous phase of a concentrated dispersion. Certain nonionic surfactants at high levels form a gel in the presence of small amount of water and other solvents. Such gelled compositions also envisaged in the present invention.

pH of the Compositions

The pH of a 1% solution of the present compositions is preferably from 6 to 12.

Making Process for the Compositions Herein

Granular compositions for use in accordance with the present invention can be made via a variety of methods including dry mixing, spray drying, agglomeration and granulation. A preferred method of making the granular compositions involves a combination of dry mixing and agglomeration techniques.

Spectrophotometric Characterization

The following technique can be used to characterize polymers spectrophotometrically to check if they have the potential to reduce porphin deposition.

First, a 0.1M phosphate buffer solution, whose pH has been adjusted to desired pH, is prepared in which the metal porphin concentration is about $10^{-5}$ molar. Second, put a 1 ml sample of the solution in a 1 ml cuvette. Third, scan the sample under the spectrophotometer. The absorbance spectrum has a peak which is characteristic of the Soret band. In the same cuvette, add increasing amounts of the polymer starting with 10 ppm and up to 1000 ppm. Gently shake the sample after each addition of polymer and wait for a few minutes before measuring the spectrum again. Compare the spectrum to the original spectrum of the porphin solution. Look for the following differences:

(i) a shift in the wavelength of the absorbance peak (i.e. a shift in the Soret band). Typical changes are in the order of 3 nm and higher.

(ii) OR a net broadening in the absorbance spectrum.

Changes in the absolute amount of absorbance alone are not significant.

As an example Fe(III)TPPS was scanned between 350 and 500 nm. The absorbance peak occurs at about 414 nm. Upon binding with PVP the maximum shifts to 419 nm.

EXAMPLE 1

Homogeneous Polar Blue (Colour Index 61135) Bleaching A solution (100 ml) of Polar Brilliant Blue dye ($6\times10^{-5}$M) and a ferric tetrasulfonated tetraphenylporphin catalyst ($1\times10^{-5}$M) was made. Its pH value was adjusted to pH 8.1. The absorbance of this solution at 620 nm, a measure of the Polar Blue dye concentration was 0.765 in a 1 cm cell. Glucose (0.1%) and glucose oxidase (2.7 U/ml) were added to the aerated solution. After 15 min the absorbance at 620 nm of the resultant solution decreased to 0.28. This corresponds to almost total oxidation of the Polar Blue dye. Blank experiments indicated no oxidation of the Polar Blue dye occurred over the same time period (as evidenced by no changes in absorbance at 620 nm)

(a) in absence of catalyst;

(b) in absence of glucose; or (c) in absence of glucose oxidase

EXAMPLE 2

Homogeneous Dye Bleaching

The extent of dye oxidation was compared between a composition containing imidazole as amine base catalyst and a system without amine base catalyst.

Composition A: A detergent solution (100 mL) containing dyes (40 ppm final concentration), glucose (0.1% by weight) and a ferric tetrasulfonated tetraphenylporphin catalyst ($1\times10^{-5}$M) was prepared and its pH value adjusted to 8.0.

Composition B: A detergent solution (100 mL) containing dyes (40 ppm final concentration), glucose (0.1% by weight), and ferric tetrasulfonated tetraphenylporphin catalyst ($2.5\times10^{-6}$M) and imidazole (10 mM) was prepared and its pH value adjusted to pH 8.0.

Test Method

The absorbance spectrum was recorded (350–750 nm). This region encompasses the wavelength maximum of the dyes (as noted in the table below) and the Soret band of the catalyst (414 nm). Glucose oxidase (final concentration 0.1 U/mL) was then added to the stirred solution to initiate the reaction. After 30 min the absorbance spectrum was recorded and the decrease in the absorbance maximum of the dyes noted.

Blank experiments indicated that no oxidation of the dyes occurred over the same period in the absence of catalyst or glucose oxidase.

| | | | % destruction of dye | |
|---|---|---|---|---|
| Dyes | CI # | lmax | COMP A | COMP B |
| Acid Blue 9 | 42000 | 630 nm | 13 | 53 |
| Direct blue 98 | 23155 | 570 nm | 62 | 90 |
| Direct blue 120 | 34090 | 570 nm | 50 | 83 |
| Acid blue 113 | 26360 | 595 nm | 39 | 95 |
| FD&C Red 40 | 16035 | 500 nm | 0 | 30 |
| Acid Yellow 40 | 18950 | 440 nm | 0 | 30 |

Conclusion: Even though a lower level of iron porphin catalyst is present in composition B, dyes are oxidized to a much bigger extent compared to composition A containing 4 times the iron porphin catalyst level.

EXAMPLE 3

Stability of the Metallo Catalysts

The stability of different porphyrins and phthalocyanines was determined in the presence of imidazole as amine base catalyst.

A detergent solution (100 mL) of glucose (0.1% by weight) and different metallo catalysts ($10\times10^{-5}$M) was prepared and the pH adjusted to 8.0. To initiate the reaction, different levels of glucose oxidase were added. The destruction of the catalyst was measured in each case by quantifying the decrease in absorption of the Sorer band (414 nm).

The catalyst destruction was compared with and without imidazole at different time intervals.

| | % catalyst destruction | | | | | |
|---|---|---|---|---|---|---|
| | No imidazole | | | With 10 mM imidazole | | |
| U Glox/mL | 10 min | 20 min | 30 min | 10 min | 20 min | 30 min |
| | Iron Tetrasulfonated tetraphenylporphin | | | | | |
| 0.1 | 53 | 7 | 0 | 92 | 87 | 82 |
| | Hemin chloride | | | | | |
| 0.05 | 67 | 42 | 29 | 100 | 93 | 89 |
| 0.25 | 33 | 21 | 13 | 92 | 68 | 49 |
| | Iron phthalocyanine tetrasulfonated | | | | | |
| 0.05 | 69 | 31 | 18 | 88 | 85 | 82 |
| 0.1 | 47 | 16 | 0 | 88 | 83 | 80 |
| | Mangano phthalocyanine tetrasulfonated | | | | | |
| 0.1 | 30 | 0 | 0 | 77 | 69 | 62 |

EXAMPLE 4

A, B and C are granular machine dishwashing detergent compositions for use in a dishwashing method in accord with the invention.

In the following detergent compositions, the abbreviated identifications have the following meanings:

Citrate: Tri-Sodium citrate dihydrate

MA/AA: Copolymers of 1:4 maleic/acrylic acid, average molecular weight about 80,000

Silicate: Amorphous Sodium Silicate ($SiO_2$:$Na_2O$ ratio normally follows)

Protease: Proteolytic enzyme sold under the trade name Savinase by Novo Industries A/S Amylase: Amylolytic enzyme sold under the trade name Termamyl by Novo Industries A/S Lipase Lipolytic enzyme sold under the trade name Lipolase by Novo Industries A/S Nonionic: $C_{13}$–$C_{15}$ mixed ethoxylated/propoxylated fatty alcohol with an average degree of ethoxylation of 3.8 and an average degree of propoxylation of 4.5 sold under the trade name Plurafac LF404 by BASF GmbH.

PVP Polyvinylpyrolidone with an average

Molecular weight of 12,000

Sulphate: Anhydrous Sodium Sulphate

The following machine dishwashing detergents according to the invention are prepared (parts by weight):

| | Parts by weight | | |
|---|---|---|---|
| Ingredients | A | B | C |
| citrate | 38.0 | 35.0 | 40.0 |
| MA/AA | 4.0 | 6.0 | 2.0 |
| Silicate (2.0 ratio) | 26.0 | 30.0 | 20.0 |
| Paraffin oil(1) | 0.5 | 0.5 | 0.3 |
| Protease | 2.0 | 2.5 | 2.2 |
| Amylase | 1.5 | 0.5 | 1.0 |
| Lipase | 2.0 | 2.0 | 2.0 |
| Nonionic(2) | 1.5 | 1.5 | 1.5 |
| Limesoap dispersant(3) | — | — | 2.5 |
| Suds suppressor | — | 1.0 | — |
| Ferric tetrasulfonated tetraphenylporphin | 0.1 | 0.1 | 0.1 |
| Glucose | 10.0 | 10.0 | 10.0 |
| Imidazole | — | 3.0 | — |
| PVP | — | — | 0.3 |
| Sulphate | | balance to 100 | |
| pH | 10.7 | 10.7 | 10.7 |

(1)WINOG 70 ex Wintershall
(2)Pre-mixed with the paraffin oil before incorporation
(3)Lutensol AO12 ex BASF To each of compositions A, B and C was added 250 units/gram of composition of glucose oxidase enzyme.

Washing Method

The compositions A, B and C were used in a machine dishwashing method employing a conventional dishwasher machine with a product dosage of 20 g of product to 5 liters of wash solution. The level of glucose oxidase enzyme in the wash solution was hence 1,000 U/l, and that of the ferric tetrasulfonated porphin was 400 ppm.

EXAMPLE 5

The propensity of blackcurrant juice to stain clear polypropylene articles under conditions similar to those which would be encountered under repeated machine dishwashing of the articles is illustrated by the following test method.

Polypropylene is commonly employed in the manufacture of food containers, which are often used to store fruits and other foodstuffs.

Test Method

A sample of clear polypropylene (a section from a resealable polypropylene lid of a food container) was immersed in a concentrated solution of blackcurrant juice at 65° C. for 6 hours. The extent of discoloration of the sample was determined by visual comparison with a sample, which had not been immersed in the blackcurrant juice solution.

Results

The extent of discoloration was clearly noticeable, and graded by comparison to be a 2 psu difference on the Scheffé scale.

EXAMPLE 6

The ability of an iron porphin/glucose oxidase system to decolourise blackcurrant juice in solution under conditions representative of those which would be encountered in a dishwashing method is now illustrated.

Test Method

A 1.7% solution of blackcurrant cordial was made up by dilution of blackcurrant concentrate with distilled water. Six 100 ml samples (A–F) of this solution were added to individual glass beakers. Samples A–C were buffered to pH 7, and samples D–F were buffered to ph 10. (Manual dishwashing methods are typically carried out at neutral pH, whereas in machine dishwashing more alkaline conditions are typical). To beakers B, C and E, F were added, with stirring, glucose oxidase, iron porphin (FePPTS) and glucose such that the concentrations by weight of each of these components in the solutions was:

| | B and E | C and F |
|---|---|---|
| Glucose oxidase | 1,000 U/l | 10,000 U/l |
| Iron porphin | 2.5 ppm | 25 ppm |
| Glucose | 0.1% | 1% |

The colour of the samples was graded visually at set time intervals from addition of the decolourising agents.

Results

| | Time | | |
|---|---|---|---|
| Sample | 0 mins | 30 mins | 60 mins |
| A(ref.) | Full purple | Full purple | Full purple |
| B | Full purple | Purple colour fading | Colourless |
| C | Full purple | Purple colour fading | Colourless |
| D(ref.) | Full purple | Full purple | Full purple |
| E | Full purple | Purple colour fading | Colourless |
| F | Full purple | Purple colour fading | Colourless |

What is claimed is:

1. A method of washing dishes wherein said dishes are treated with an effective mount of a detergent composition comprising:

A. a metallo catalyst selected from a) metallo porphin and water-soluble or water dispersable derivatives thereof;

b) metallo porphyrin and water-soluble or water-dispersable derivatives thereof c) metallo phthalocyanine and water-soluble or water-dispersable derivatives thereof;

B. an enzymatic system capable of generating hydrogen peroxide;

and wherein further said metallo catalyst is present at a level of from $10^{-8}$ molar to $10^{-3}$ molar and said enzymatic system is present at a level to provide in the dishwashing method a constant generation of 0.005 to 10 ppm AvO per minute.

2. A dishwashing method according to claim 1 wherein said enzymatic system comprises an oxidase and as a substrate an alcohol, an aldehyde or a combination of both.

3. A dishwashing method according to claim 1, wherein said detergent composition comprises a metallo porphin derivative, wherein said metallo porphin is substituted on at least one of its meso positions with a phenyl or pyridyl substituent selected from the group consisting of

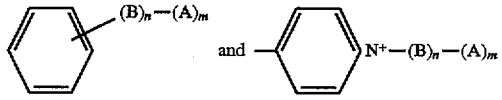

wherein n and m may be 0 or 1, A is selected from the group consisting of sulfate, sulfonate, phosphate, and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

4. A dishwashing method according to claim 3 wherein the phenyl or pyridyl groups are substituted with —$CH_3$, —$C_2H_5$, —$CH_2CH_2CH_2SO_3$—, —$CH_2COO$—, —$CH_2CH(OH)CH_2SO_3$—, or —$SO_3$.

5. A dishwashing method according to claim 1, wherein said detergent composition comprises a metallo porphin derivative, wherein said metallo porphin is substituted on at least one of its meso positions with a phenyl substituent selected from the group consisting of

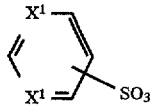

wherein $X^1$ is (=CY—) wherein each Y, independently, is hydrogen, chlorine, bromine or meso substituted alkyl, cycloalkyl, aralkyl, aryl, alkaryl or heteroaryl.

6. A dishwashing method according to claim 1 wherein the metallo of said metallo catalyst is Fe, Mn, Co, Rh, Cr, Ru, Mo or other transition metals.

7. A dishwashing method according to claim 1 wherein said detergent composition further comprises from 0.01% to 5% by weight of a polymer selected from a) alkoxy containing polymers b) hydroxy containing polymers c) thiol containing polymers d) amide containing polymers e) heterocyclic amines containing polymers f) polyamines g) polyurethanes h) polyacrylonitrile.

8. A dishwashing method according to claim 7 wherein the alkoxy containing polymer is polyethylene glycol or a copolymer of ethylene-propylene glycol or polyethylene terephthalate and derivatives thereof.

9. A dishwashing method according to claim 7 wherein the amide containing polymer is polyvinylpyrrolidone and derivatives thereof.

10. A dishwashing method according to claim 7 wherein the heterocyclic amines containing polymer is polyvinylimidazoline and derivatives thereof.

11. A dishwashing method according to claim 7 wherein the hydroxy containing polymer is polyvinylalcohol and derivatives thereof.

12. A dishwashing method according to claim 1 wherein said detergent composition further comprises an amine base catalyst stabilizer capable of binding to the 5th ligand of the metallo catalyst, wherein said metallo catalyst is an iron porphin, and wherein further the molar ratio of the iron porphin catalyst to amine base catalyst is from 1:1 to 1:5000.

13. A dishwashing method according to claim 12 wherein said amine base catalyst stabilizer is selected from imidazole and derivatives thereof.

14. A dishwashing method according to claim 12 wherein said amine base catalyst stabilizer is selected from pyridine and its derivatives thereof.

15. A machine dishwashing method according to claim 1 wherein said detergent composition further comprises from 1% to 80% by weight of detergent builder compound.

16. A machine dishwashing method according to claim 1 wherein said detergent composition further comprises from 0.5% to 50% by weight of surfactant.

17. A machine dishwashing method according to claim 1 wherein said detergent composition further comprise one or more enzymes selected from amylases, proteases, lipases and esterases.

18. A machine dishwashing method according to claim 1 wherein said detergent composition further comprises from 0.05% to 2.5% by weight of paraffin oil.

* * * * *